US010519010B2

(12) United States Patent
Miyazaki et al.

(10) Patent No.: US 10,519,010 B2
(45) Date of Patent: Dec. 31, 2019

(54) CRANE

(71) Applicant: KOBELCO CONSTRUCTION MACHINERY CO., LTD., Hiroshima-shi (JP)

(72) Inventors: Kazuyuki Miyazaki, Hyogo (JP); Shingo Kurihara, Hyogo (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 359 days.

(21) Appl. No.: 15/325,452

(22) PCT Filed: Jul. 23, 2015

(86) PCT No.: PCT/JP2015/070911
§ 371 (c)(1),
(2) Date: Jan. 11, 2017

(87) PCT Pub. No.: WO2016/017512
PCT Pub. Date: Feb. 4, 2016

(65) Prior Publication Data

US 2017/0158470 A1 Jun. 8, 2017

(30) Foreign Application Priority Data

Jul. 29, 2014 (JP) ..... 2014-153649

(51) Int. Cl.
*B66C 23/60* (2006.01)
*B66C 23/62* (2006.01)
*B66C 23/72* (2006.01)

(52) U.S. Cl.
CPC ..... *B66C 23/60* (2013.01); *B66C 23/62* (2013.01); *B66C 23/72* (2013.01)

(58) Field of Classification Search
CPC ..... B66C 23/60; B66C 23/62; B66C 23/66; B66C 23/72; B66C 23/82
See application file for complete search history.

(56) References Cited

U.S. PATENT DOCUMENTS 4,573,593 A 3/1986 Lietzau
5,145,075 A 9/1992 Johnson et al.
(Continued)

FOREIGN PATENT DOCUMENTS

AU 632712 B2 1/1993
CN 1740079 A 3/2006
(Continued)

OTHER PUBLICATIONS

International Search Report dated Oct. 20, 2015 in PCT/JP2015/070911 filed Jul. 23, 2015.
Combined Office Action and Search Report dated Sep. 21, 2017 in Chinese Patent Application No. 201580040795.1 (with unedited computer generated English translation of the Office Action and English translation of categories of cited documents).
(Continued)

*Primary Examiner* — Emmanuel M Marcelo
(74) *Attorney, Agent, or Firm* — Oblon, McClelland, Maier & Neustadt, L.L.P.

(57) ABSTRACT

A crane includes a boom and a derricking mechanism, wherein: the derricking mechanism includes a linking device connecting one end of a guy line to a distal end of the boom; the linking device includes a joint connected to one end of the guy line, and a support device provided on the distal end to support the joint so as to locate the joint at a position away from the back surface and opposite to the ventral surface; and the support device includes a holding member which holds the joint, the holding member allowing the position of the joint to be selectively changed to a plurality of different positions in a first direction perpendicularly intersecting an axis of the boom and a rotary axis of the boom.

5 Claims, 9 Drawing Sheets

(56) References Cited

U.S. PATENT DOCUMENTS

| | | | | |
|---|---|---|---|---|
| 6,669,038 | B1 * | 12/2003 | Zingerman | B66C 23/62 212/232 |
| 2005/0098522 | A1 * | 5/2005 | Mizuta | B66C 23/62 212/298 |
| 2006/0037926 | A1 | 2/2006 | Kimura et al. | |
| 2008/0093321 | A1 * | 4/2008 | Miyazaki | B66C 23/62 212/177 |
| 2010/0072158 | A1 * | 3/2010 | Wanek | B66C 23/36 212/294 |
| 2012/0152878 | A1 * | 6/2012 | Ishihara | B66C 23/365 212/280 |
| 2014/0083964 | A1 * | 3/2014 | Kurotsu | B66C 23/66 212/177 |
| 2017/0328511 | A1 * | 11/2017 | Wiethorn | F16M 3/00 |

FOREIGN PATENT DOCUMENTS

| | | | |
|---|---|---|---|
| CN | 102020208 | A | 4/2011 |
| JP | 60-33594 | U | 3/1985 |
| JP | 6-94348 | B2 | 11/1994 |
| JP | 9-142785 | A | 6/1997 |
| JP | 11-43288 | A | 2/1999 |
| JP | 2000-143169 | A | 5/2000 |
| JP | 2006-206233 | A | 8/2006 |
| JP | 2014-43329 | A | 3/2014 |

OTHER PUBLICATIONS

Extended European Search Report dated Feb. 28, 2018 in Patent Application No. 15827964.6, 9 pages.

* cited by examiner

CRANE

TECHNICAL FIELD

The present invention relates to a crane.

BACKGROUND ART

Cranes which include a boom capable of being raised and lowered and a derricking mechanism for raising and lowering the boom are conventionally known. Patent Literature 1 mentioned below discloses an example of such cranes.

In the crane disclosed in Patent Literature 1, the boom has a proximal end mounted on a front portion of a machine body of the crane rotatably about an axis extending in a widthwise direction of the machine body. On the machine body, a live mast is disposed behind the boom and a high mast is disposed behind the live mast. Each of the live mast and the high mast has a proximal end mounted on the machine body rotatably about an axis extending in the widthwise direction of the machine body so as to be rotatable about the proximal end.

A top link is disposed on a ventral surface of a distal end of the boom. A top sheave is disposed at the top link, and a hook for hanging a hoisting load is suspended from the top sheave via a hook rope. A pendant link is secured to a back surface of the distal end of the boom. A rear end of the pendant link and a distal end of the live mast are connected via a pendant corresponding to a guy line.

A boom rope is wound around a sheave disposed at a distal end of the high mast and a sheave disposed at the distal end of the live mast, and is wound in and out by a winch disposed on the machine body. The winch winds in the boom rope to rotate the live mast rearward so that the distal end of the live mast approaches the distal end of the high mast. Consequently, the pendant is drawn rearward to draw the distal end of the boom rearward so that the boom is positioned vertically.

In this crane, owing to the pendant link projecting rearward from the distal end of the boom, the connection position of the pendant is spaced behind the distal end of the boom. Consequently, the acting position of a compressive force lies at a position close to an axis of the boom, the compressive force acting on the boom as the resultant of a tensile force of the pendant and a hoisting load. This allows the boom to withstand a great compressive force to thereby improve the hoisting capacity of the crane.

It is common to use a boom having a structure that allows the length of the boom to be changed, and change the length of the boom to an appropriate length depending on the contents of hoisting wok, the conditions of work site, or the like. In the above-described crane of Patent Literature 1, the hoisting capacity is improved by providing the pendant link; however, there is a possibility that the hoisting capacity cannot be prevented from decreasing when the boom is made shorter. Further, when the boom is made longer, another problem is liable to occur that the tensile force required to raise the boom being in the horizontal position increases.

Specifically, when the boom is made shorter, the angle between the extension direction of the pendant and the acting direction of a hoisting load increases. Consequently, the acting position of a compressive force is spaced in front of the axis of the boom, which results in a greater bending moment. Consequently, the hoisting capacity cannot be prevented from being reduced in order to avoid deflection of the boom. On the other hand, when the boom is made longer, the angle between the pendant and the axis of the boom decreases in a substantially horizontal position of the boom. This makes the vertical component of a tensile force of the pendant small. As a result, a greater tensile force of the pendant is required to raise the boom.

CITATION LIST

Patent Literature

Patent Literature 1: Japanese Unexamined Patent Publication No. HEI 11-43288

SUMMARY OF INVENTION

An object of the present invention is to provide a crane capable of achieving both an improvement of the hoisting capacity and the reduction of the tensile force required to raise a boom.

A crane according to an aspect of the present invention comprises: a machine body; a boom rotatably mounted on the machine body and having a structure which allows the length of the boom to be changed; and a derricking mechanism configured to rotate the boom to raise and lower the boom with respect to the machine body, wherein: the derricking mechanism includes a guy line, a linking device provided on a distal end of the boom to connect one end of the guy line to the distal end of the boom, and a guy line operating device configured to draw the guy line rearward to raise the boom and configured to advance the guy line to lower the boom; the distal end of the boom has a back surface which faces rearward when the boom is in a vertical position, and a ventral surface which faces forward when the boom is in the vertical position; the linking device includes a joint connected to one end of the guy line, and a support device provided on the distal end to support the joint so as to locate the joint at a position away from the back surface and opposite to the ventral surface; and the support device includes a holding member which holds the joint, the holding member allowing the position of the joint to be selectively changed to a plurality of different positions in a first direction perpendicularly intersecting an axis of the boom and a rotary axis of the boom.

DESCRIPTION OF EMBODIMENTS

Embodiments of the present invention will be described below with reference to the accompanying drawings.

First Embodiment

A crane according to a first embodiment of the present invention will be described with reference to FIGS. 1 to 6.

Figure 1:
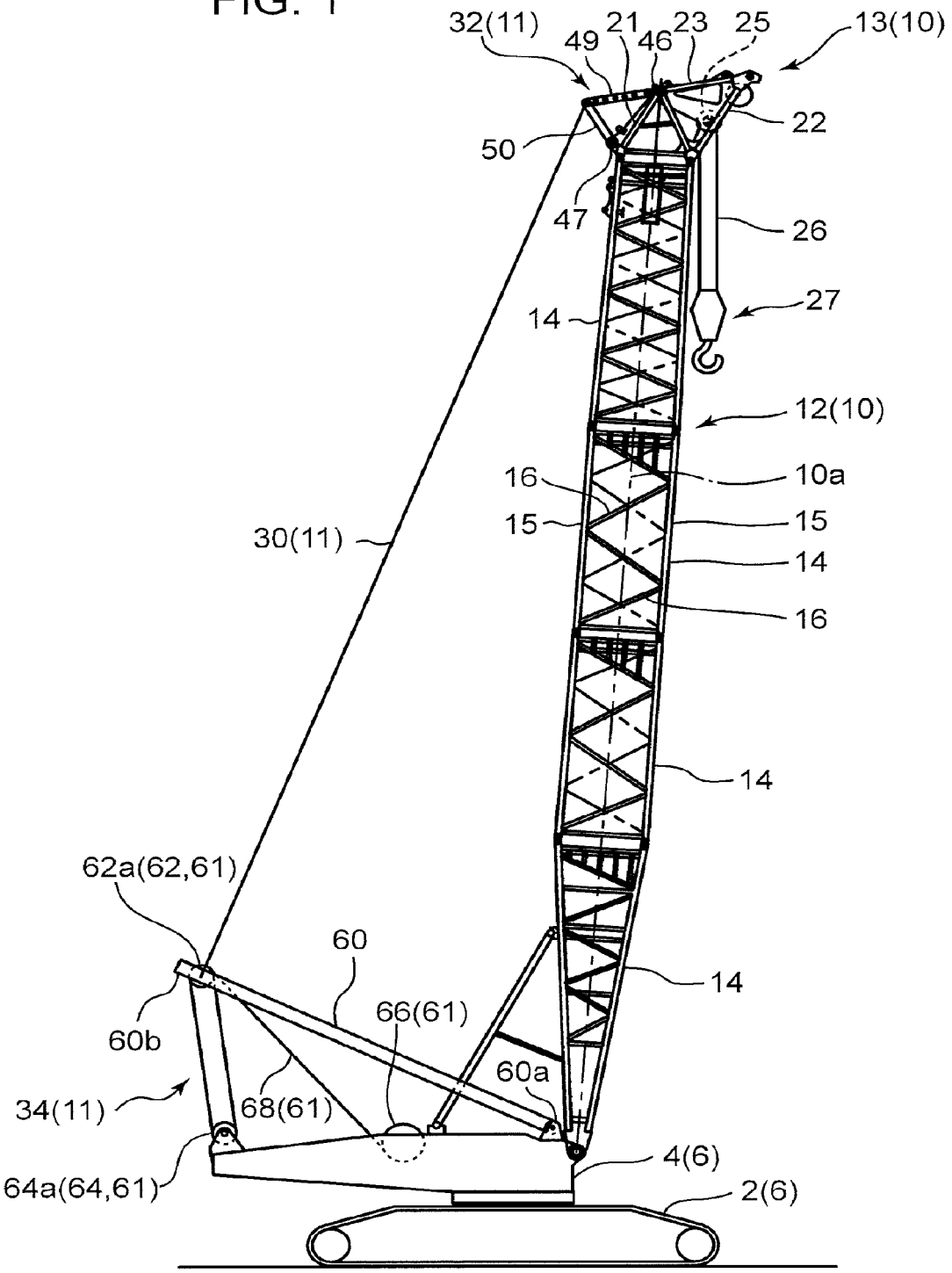
FIG. 1 is a side view of a crane according to a first embodiment of the present invention with a boom being in a vertical position.

The crane according to the first embodiment includes a machine body 6 having a self-propelled lower travelling body 2, and an upper slewing body 4 mounted on the lower travelling body 2 pivotally about a vertical axis, as shown in FIG. 1. In the first embodiment, the lower travelling body 2 is of a crawler type, but is not limited to this type. For example, the lower travelling body 2 may be of a wheel type.

It should be noted that in the description hereinafter given, the terms "forward" and "rearward" mean towards the front and towards the rear of the upper slewing body 4, respectively. In other words, the right side of FIG. 1 corresponds to "forward" and the left side of FIG. 1 corresponds to "rearward". In addition, in the description hereinafter given, the term "widthwise direction" means a widthwise direction of the upper slewing body 4, which is a direction horizontally and perpendicularly intersecting the front-rear direction. In other words, the "widthwise direction" corresponds to a direction perpendicularly intersecting the drawing sheet surface of FIG. 1.

The crane according to the first embodiment includes, as shown in FIG. 1, a boom 10 mounted on the upper slewing body 4 of the machine body 6 rotatably about a rotary axis extending in the widthwise direction, and a derricking mechanism 11 configured to rotate the boom 10 to raise and lower the boom 10 with respect to the upper slewing body 4.

The boom 10 is in the form of a lattice boom having a lattice structure and having a longer dimension in one direction. The boom 10 is configured in such a manner as to allow its axial length to be changed. The boom 10 includes a boom body 12 and a boom head 13.

The boom body 12 constitutes a large portion of the boom 10, and includes a plurality of boom units 14 having a lattice structure and linked with each other. A proximal end, which is a longitudinal one end, of the boom body 12 constitutes a proximal end of the boom 10 and is mounted on a front end of the upper slewing body 4. The proximal end of the boom body 12 is mounted on the upper slewing body 14 rotatably about the rotary axis extending in the widthwise direction. This allows the boom 10 to be raised and lowered with the proximal end of the boom body 12 serving as a fulcrum.

Each boom unit 14 includes four main members 15 and a plurality of lattice members 16 each connecting one main member 15 to another. It should be noted that because the drawings are side views of the boom 10, only two of the four main members 15 are shown in the drawings. The main members 15 are respectively disposed in such a manner as to constitute the vertices of a rectangle in the cross section perpendicularly intersecting the longitudinal direction of the boom 10. The boom 10 has an axis 10*a* extending in the longitudinal direction of the boom 10 and passing through the center of the four main members 15 in the cross section perpendicularly intersecting the longitudinal direction of the boom 10. The respective one main members 15 of adjacent boom units 14 are detachably connected to each other. It is possible to change the axial length of the boom 10 by changing the number of boom units 14 to be connected or replacing a boom unit 14 to be used with another having a different axial length.

The boom head 13 is mounted on the other end of the boom body 12 opposite to the proximal end, and constitutes a distal end of the boom 10. The boom head 13 serves as an example of a distal end of a boom of the present invention. The boom head 13 has, as shown in FIG. 1, a back surface 21 that faces rearward, and a ventral surface 22 that faces forward, and a top surface 23 that faces upward when the boom 10 is in a vertical position.

A top sheave 25 is disposed on a portion of the ventral surface 22 of the boom head 13 rotatably about a horizontal axis extending in the widthwise direction. As shown in FIG. 1, a hook device 27 is hung from the top sheave 25 via a hoisting rope 26. The hook device 27 includes an unillustrated rotatable hook sheave. The hoisting rope 26 drawn from an unillustrated winding-up winch mounted on the upper slewing body 4 is wound around the hook sheave and the top sheave 25. The winding-up winch winds in or out the hoisting rope 26 to raise or lower the hook device 27 and a hoisting load hung thereby.

The derricking mechanism 11 (see FIG. 1) includes two guy lines 30, two linking devices 32, and a guy line operating device 34.

The guy lines 30 and the linking devices 32 connect a distal end 60*b* of a crane mast 60 described later and the boom head 13.

The two guy lines 30 are spaced from each other in the widthwise direction of the upper slewing body 4. Because the two guy lines 30 overlap when seen from a lateral side of the upper slewing body 4, only one of the guy lines 30 is shown in the drawings. The two linking devices 32 are disposed on the boom head 13, and are spaced from each other in the widthwise direction. The two linking devices 32 also overlap when seen from the lateral side of the upper slewing body 4 and, therefore, only one of the linking devices 32 is shown in the drawings.

One of the linking devices 32 connects one end of a corresponding one of the guy lines 30 to the boom head 13. The other of the linking devices 32 connects one end of the corresponding other of the guy lines 30 to the boom head 13. The respective other ends of the guy lines 30 are connected to the distal end 60*b* of the crane mast 60 described later. One of the linking devices 32 is disposed at one end of the boom head 13 in the widthwise direction, and the other of the linking devices 32 is disposed at the other end of the boom head 13 in the widthwise direction. The two linking devices 32 have the same configuration and, therefore, the structure of one linking device 32 will be representatively described hereinafter.

Figure 2:
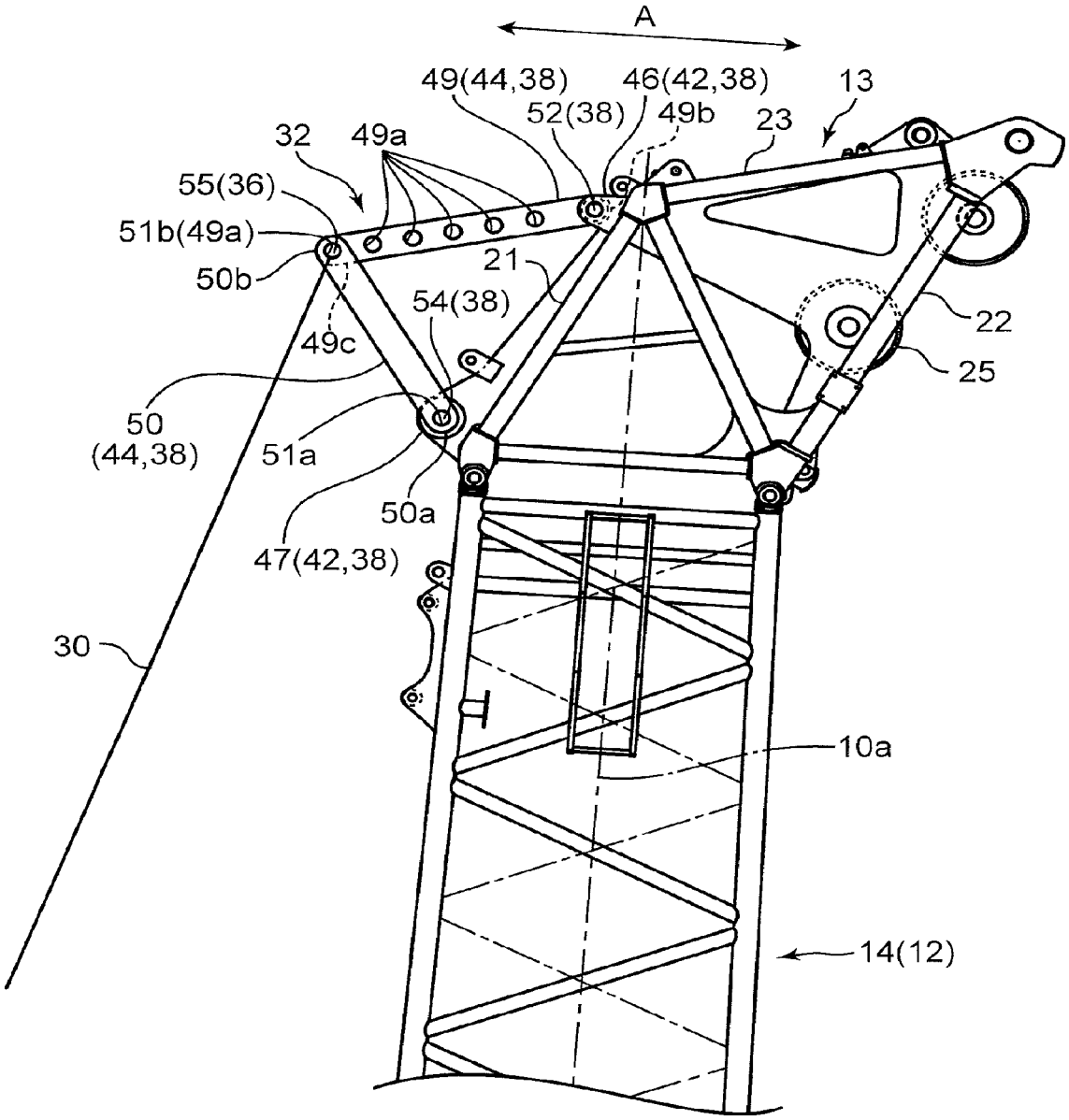
FIG. 2 is an enlarged view of a distal end of the boom of the crane shown in FIG. 1.

The linking device 32 includes, as shown in FIG. 2, a joint 36 and a support device 38.

The joint 36 is a portion to which the one end of the guy line 30 is coupled. The joint 36 includes a pin 55, and an unillustrated connection member such as shackle attached to the pin 55. The pin 55 connects a first linking member 49 and a second linking member 50 of the support device 38 described later. The one end of the guy line 30 is coupled to the connection member attached to the pin 55.

The support device 38 is provided on the boom head 13 to support the joint 36 so as to locate the joint 36 at a position away from the back surface 21 and opposite to the ventral surface 22 of the boom head 13. The support device 38 includes, as shown in FIG. 2, an attachment section 42, a guy line offset link 44 (hereinafter, referred to simply as "link 44"), and pins 52, 54.

The attachment section 42 is a portion to which the link 44 is attached. The attachment section 42 is fixedly provided on the back surface 21 of the boom head 13 in such a way as to project from the back surface 21 in a direction away from the ventral surface 22, and supports the link 44. The attachment section 42 includes, as shown in FIG. 2, a first attachment member 46 and a second attachment member 47.

The first attachment member 46 is in the form of two plates and disposed vertically on the back surface 21 and near the top surface 23 of the boom head 13. The two plates of the first attachment member 46 are disposed in such a way that a plate thickness direction thereof coincides with the widthwise direction. The two plates are slightly spaced from each other in the widthwise direction. Each plate is formed with an attachment hole passing therethrough in the plate thickness direction at the same position.

The second attachment member 47 is in the form of a single plate and disposed vertically on the back surface 21. The second attachment member 47 is disposed in such a way that a plate thickness direction thereof coincides with the widthwise direction, and is disposed in the middle between two plates of the first attachment member 46. The second attachment member 47 is formed with an attachment hole passing therethrough in the plate thickness direction. The attachment hole is located at a position near a proximal end of the boom head 13, the proximal end being disposed at the side opposite to the top surface 23 (at the side closer to the boom body 12).

The link 44 is attached to the attachment section 42 and supports the joint 36. The link 44 is attachable to and detachable from the attachment section 42. The link 44 includes, as shown in FIG. 2, the first linking member 49 and the second linking member 50.

The first linking member 49 serves as an example of a holding member of the present invention. The first linking member 49 holds the pin 55 of the joint 36. The first linking member 49 provides the joint 36 with a plurality of different positions in an A-direction perpendicularly intersecting the axis 10*a* of the boom 10 and the rotary axis of the boom 10 to allow positional change of the joint 36.

Specifically, the first linking member 49 is in the form of a long and narrow flat plate. The first linking member 49 is formed with a plurality of holes 49*a* passing therethrough in its plate thickness direction. The holes 49*a* serve as an example of holding parts of the present invention. The plurality of holes 49*a* are disposed at intervals in a longitudinal direction of the first linking member 49. Each hole 49*a* is configured to detachably hold the pin 52. The first linking member 49 includes a proximal end 49*b* and a distal end 49*c* constituting opposite ends thereof in the longitudinal direction. Each of the proximal end 49*b* and the distal end 49*c* of the first linking member 49 is also formed with the hole 49*a*.

The proximal end 49*b* of the first linking member 49 is placed between the two plates of the first attachment member 46. The pin 52 is fitted into the hole 49*a* formed in the proximal end 49*b* of the first linking member 49 and the attachment holes respectively formed in the two plates of the first attachment member 46 to attach the proximal end 49*b* of the first linking member 49 to the first attachment member 46. The pin 52 can be inserted to and removed from the hole 49*a* of the proximal end 49*b* and the attachment holes of the first attachment member 46. The proximal end 49*b* can be detached from the first attachment member 46 by removing the pin 52 from these holes. In other words, the proximal end 49*b* of the first linking member 49 is attachable to and detachable from the first attachment member 46.

The second linking member 50 serves as an example of a supporting member of the present invention. The second linking member 50 extends in a direction intersecting the first linking member 49 and the back surface 21 of the boom head 13, and is disposed between the first linking member 49 and the back surface 21 of the boom head 13. The second linking member 50 is coupled with the pin 55 of the joint 36 held by the first linking member 49 to support the first linking member 49 at the position of the pin 55 via the pin 55.

Specifically, the second linking member 50 is in the form of two long and narrow flat plates. The two flat plates have the same shape. Each flat plate of the second linking member 50 includes a proximal end 50*a* and a distal end 50*b* constituting opposite ends thereof in the longitudinal direction. The proximal end 50*a* of each flat plate is formed with a hole 51*a* passing therethrough in its plate thickness direction. The distal end 50*b* of each flat plate is formed with a hole 51*b* passing therethrough in its plate thickness direction.

The proximal ends 50*a* of the two flat plates of the second linking member 50 are connected to the second attachment member 47. Specifically, the proximal ends 50*a* are placed on both sides of the second attachment member 47 in its plate thickness direction in such a way that the holes 51*a* communicate with the attachment hole of the second attachment member 47 and, in this state, the pin 54 is fitted into the holes 51*a* of the proximal ends 50*a* and the attachment hole of the second attachment member 47. Consequently, the proximal ends 50*a* of the second linking member 50 are attached to the second attachment member 47. The pin 54 can be inserted to and removed from the holes 51*a* of the proximal ends 50*a* and the attachment hole of the second attachment member 47. The proximal ends 50*a* can be detached from the second attachment member 47 by removing the pin 54 from these holes. In other words, the proximal ends 50*a* of the second linking member 50 are attachable to and detachable from the second attachment member 47.

Further, the distal ends 50*b* of the two flat plates of the second linking member 50 are connected to the first linking member 49. Specifically, the distal ends 50*b* are placed on both sides of the first linking member 49 in its plate thickness direction in such a way that the holes 51*b* communicate with one of the plurality of holes 49*a* formed in the first linking member 49 and, in this state, the pin 55 is fitted into the one hole 49*a* corresponding to the holes 51*b*. Consequently, the distal ends 50*b* of the second linking member 50 are attached to the first linking member 49. The pin 55 can be inserted to and removed from the holes 51*b* of the distal ends 50*b* and the hole 49*a* of the first linking member 49. The first linking member 49 can be detached from the distal ends 50*b* of the second linking member 50 by removing the pin 55 from the holes 49*a* and 51*b*. In other words, the distal ends 50*b* of the second linking member 50 are detachably connected to the first linking member 49. The second linking member 50 supports a portion of the first linking member 49 where the hole 49*a* fitted with the pin 55 is formed, via the pin 55.

The first linking member 49 extends in a direction substantially parallel to the A-direction while being attached to the first attachment member 46 and connected to the second linking member 50 which is attached to the second attachment member 47. In other words, the first linking member 49 has a predetermined length in the A-direction while being supported by the second linking member 50 and the pin 55. Because the plurality of holes 49*a* are aligned in the longitudinal direction of the first linking member 49, in the state that the first linking member 49 is supported by the second linking member 50 and the pin 55, the plurality of holes 49*a* are disposed at a plurality of different positions in the A-direction. Therefore, the pin 55 is fitted into a hole 49*a* selected from the plurality of holes 49*a* and into the holes 51*b* of the second linking member 50, to connect the distal ends 50*b* of the second linking member 50 to the first linking member 49 at the position of the selected hole 49*a*. Consequently, the joint 36 can be positioned at a specific position in the A-direction that corresponds to the selected hole 49*a*. Further, the position of the joint 36 can be changed in the A-direction by removing the pin 55 from the hole 49*a* and the holes 51*b* of the second linking member 50 fitted with the pin 55, and then bringing the holes 51*b* of the second linking member 50 into communication with another hole 49*a* and fitting the pin 55 into the another hole 49*a* and the holes 51*b* to change the position where the distal ends 50*b* of the second linking member 50 is connected to the first linking member 49.

When, for example as shown in FIG. 2, the pin 55 is fitted into the hole 49*a* formed at the distal end 49*c* of the first linking member 49 and the holes 51*b* of the distal ends 50*b* of the second linking member 50 to connect the distal ends 50*b* of the second linking member 50 to the distal end 49*c* of the first linking member 49, the joint 36 lies at a position furthest from the back surface 21 of the boom head 13 within the range of positional change of the joint 36 in the A-direction.

Figure 3:
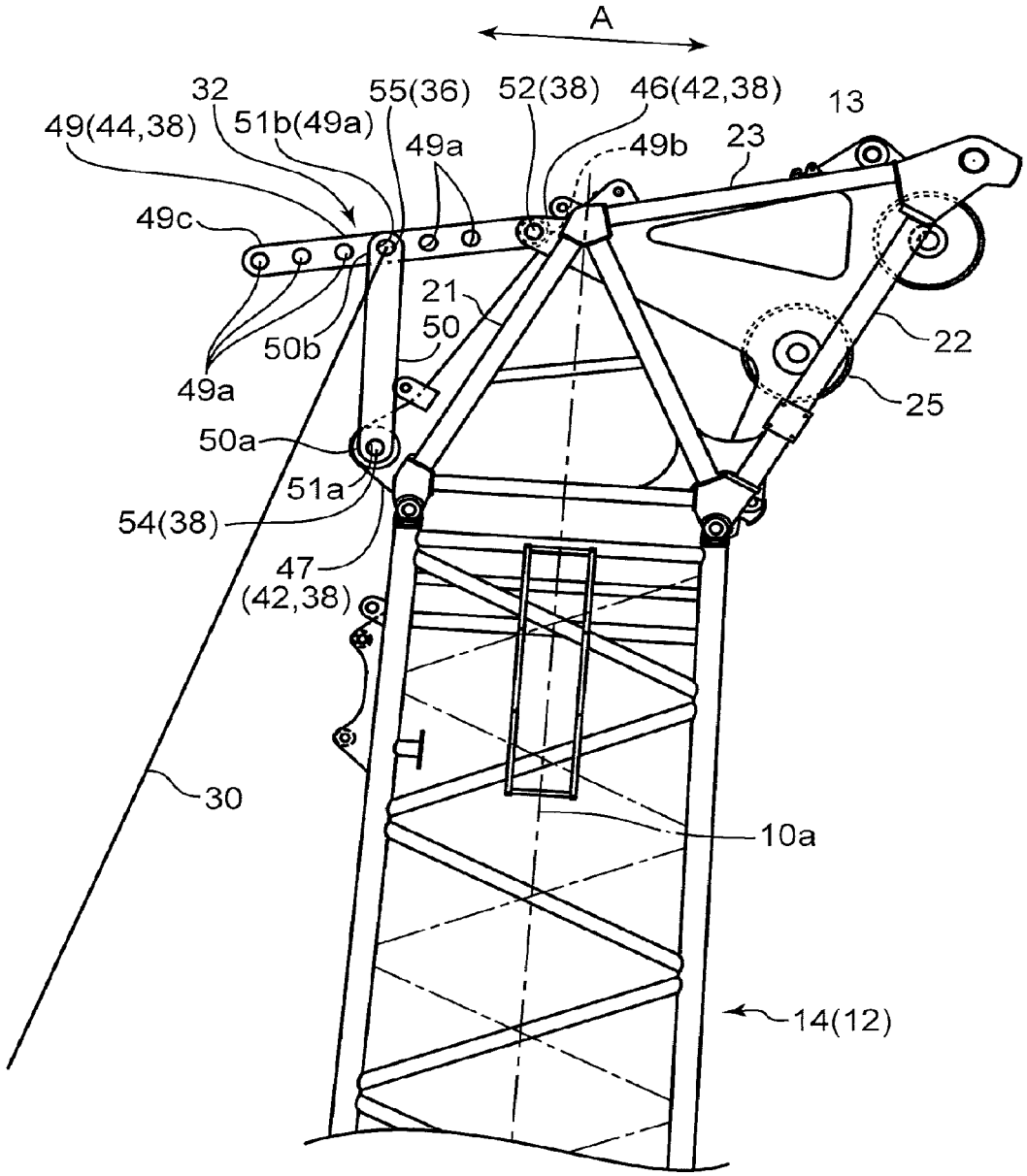
FIG. 3 is a view showing a form of a guy line offset link adopted when a boom longer than the boom shown in FIG. 1 is used in the crane, the view corresponding to FIG. 2.

Further, when, for example as shown in FIG. 3, the pin 55 is fitted into the hole 49*a* formed at a position between the distal end 49*c* and the proximal end 49*b* of the first linking member 49 and the holes 51*b* of the distal ends 50*b* of the second linking member 50 to connect the distal ends 50*b* of the second linking member 50 to a portion of the first linking member 49 where the hole 49*a* fitted with the pin 55 is formed, the joint 36 lies at a position closer to the back surface 21 of the boom head 13 in the A-direction than in the case shown in FIG. 2.

As described, the joint 36 can be disposed at a position closer to the back surface 21 of the boom head 13 by fitting the pin 55 into a hole 49*a* among the plurality of holes 49*a* formed in the first linking member 49 that lies at a position closer to the proximal end 49*b*. On the contrary, the joint 36 can be disposed at a position farther from the back surface 21 of the boom head 13 and further away from the ventral surface 22 by fitting the pin 55 into a hole 49*a* among the plurality of holes 49*a* formed in the first linking member 49 that lies at a position closer to the distal end 49*c* to connect the distal ends 50*b* of the second linking member 50 thereto.

The guy line operating device 34 (see FIG. 1) draws the guy lines 30 rearward to raise the boom 10, and advances the guy lines 30 to lower the boom 10. The guy line operating device 34 includes the crane mast 60 and a mast rotating device 61.

The crane mast 60 includes, as shown in FIG. 1, a proximal end 60*a* mounted on the upper slewing body 4 at a position behind the position where the proximal end of the boom 10 is mounted. The proximal end 60*a* is mounted on the upper slewing body 4 rotatably about a horizontal axis extending in the widthwise direction. Consequently, the crane mast 60 is rotatable about the horizontal axis with the proximal end 60*a* serving as the center of the movement. To the distal end 60*b* of the crane mast 60 opposite to the proximal end 60*a*, the respective ends of the guy lines 30 opposite to the one ends connected to the joints 36 are connected. When the boom 10 is in the vertical position (see FIG. 1), the distal end 60*b* of the crane mast 60 lies at a level significantly lower than the boom head 13. On the other hand, when the boom 10 is in a horizontal position (not shown) in which the boom 10 extends in a substantially horizontal direction forwardly with respect to the upper slewing body 4, the boom head 13 lies at a level lower than the distal end 60*b* of the crane mast 60.

The mast rotating device 61 is configured to rotate the crane mast 60 to draw the guy lines 30 rearward or advance the guy line 30. The mast rotating device 61 includes, as shown in FIG. 1, an upper spreader 62, a lower spreader 64, a derricking winch 66, and a derricking rope 68.

The upper spreader 62 is mounted on the distal end 60*b* of the crane mast 60. The upper spreader 62 includes an upper sheave 62*a* rotatable about a horizontal axis extending in the widthwise direction.

The lower spreader 64 is disposed at a rear end of the upper slewing body 4. The lower spreader 64 includes a lower sheave 64*a* rotatable about a horizontal axis extending in the widthwise direction.

The derricking winch 66 is mounted on the upper slewing body 4. The derricking rope 68 drawn from the derricking winch 66 is wound around the upper sheave 62*a* and the lower sheave 64*a*. The derricking winch 66 winds in and out the derricking rope 68.

The derricking winch 66 winds in the derricking rope 68 to draw the upper spreader 62 toward the lower spreader 64 to rotate the crane mast 60 rearward. Consequently, the guy lines are drawn rearward by the crane mast 60. As a result, the boom head 13 is drawn rearward via the guy lines 30 and the linking devices 32 so that the boom 10 is raised.

On the other hand, the derricking winch 66 winds out the derricking rope 68 to increase the distance between the upper spreader 62 and the lower spreader 64 and rotate the crane mast 60 forward with the crane mast 60 supporting the load of the boom 10 and a hoisting load via the guy lines 30. Consequently, the guy lines 30 are advanced. As a result, the boom 10 rotates forward to be lowered.

In the first embodiment, as described above, the joint 36 (see FIG. 2) connected to the one end of the guy line 30 is supported by the support device 38 at a position away from the back surface 21 and opposite to the ventral surface 22 of the boom head 13. Therefore, it is possible to locate the acting position of a compressive force close to the axis 10*a* of the boom 10, the compressive force acting on the boom 10 as the resultant of a tensile force of the guy line 30 and a hoisting load when the boom 10 is in the vertical position. This makes the bending moment due to the compressive force acting on the boom 10 small.

Figure 5:
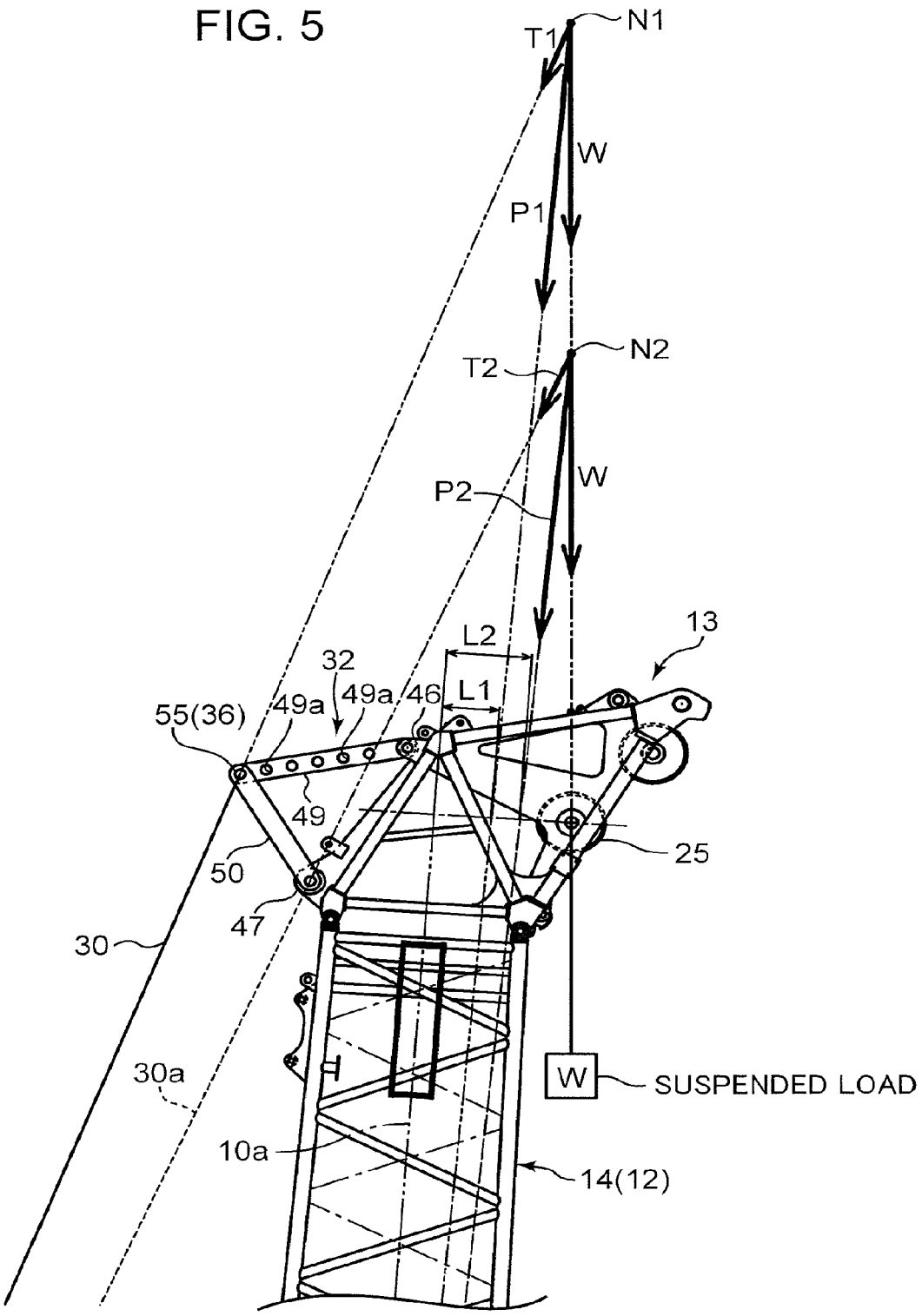
FIG. 5 is an enlarged view of the distal end of the boom for explaining the difference between a compressive force acting on the boom in the crane of the first embodiment shown in FIG. 1 and a compressive force acting on a boom in the crane of the comparative example shown in FIG. 4.
Figure 6:
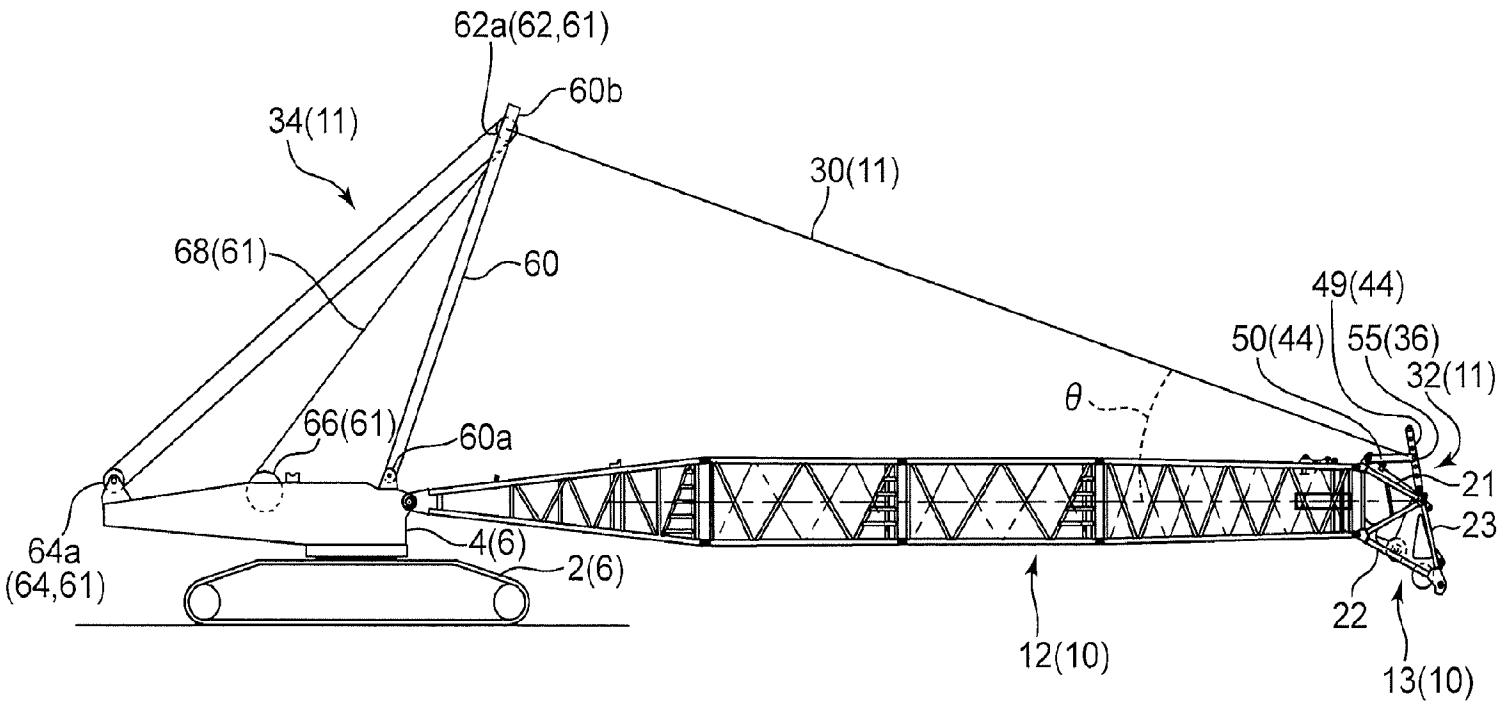
FIG. 6 is a side view of the crane according to the first embodiment of the present invention with the boom being in a horizontal position.

Specifically, as shown in FIG. 5, in the first embodiment, a compressive force P1 that acts on the boom 10 can be calculated as the resultant of a tensile force T1 of the guy line 30 and a hoisting load W at an intersection point N1 where the extension of the guy line 30 connected to the joint 36 meets the straight line extending vertically upward from the rotary axis of the top sheave 25.

Figure 4:
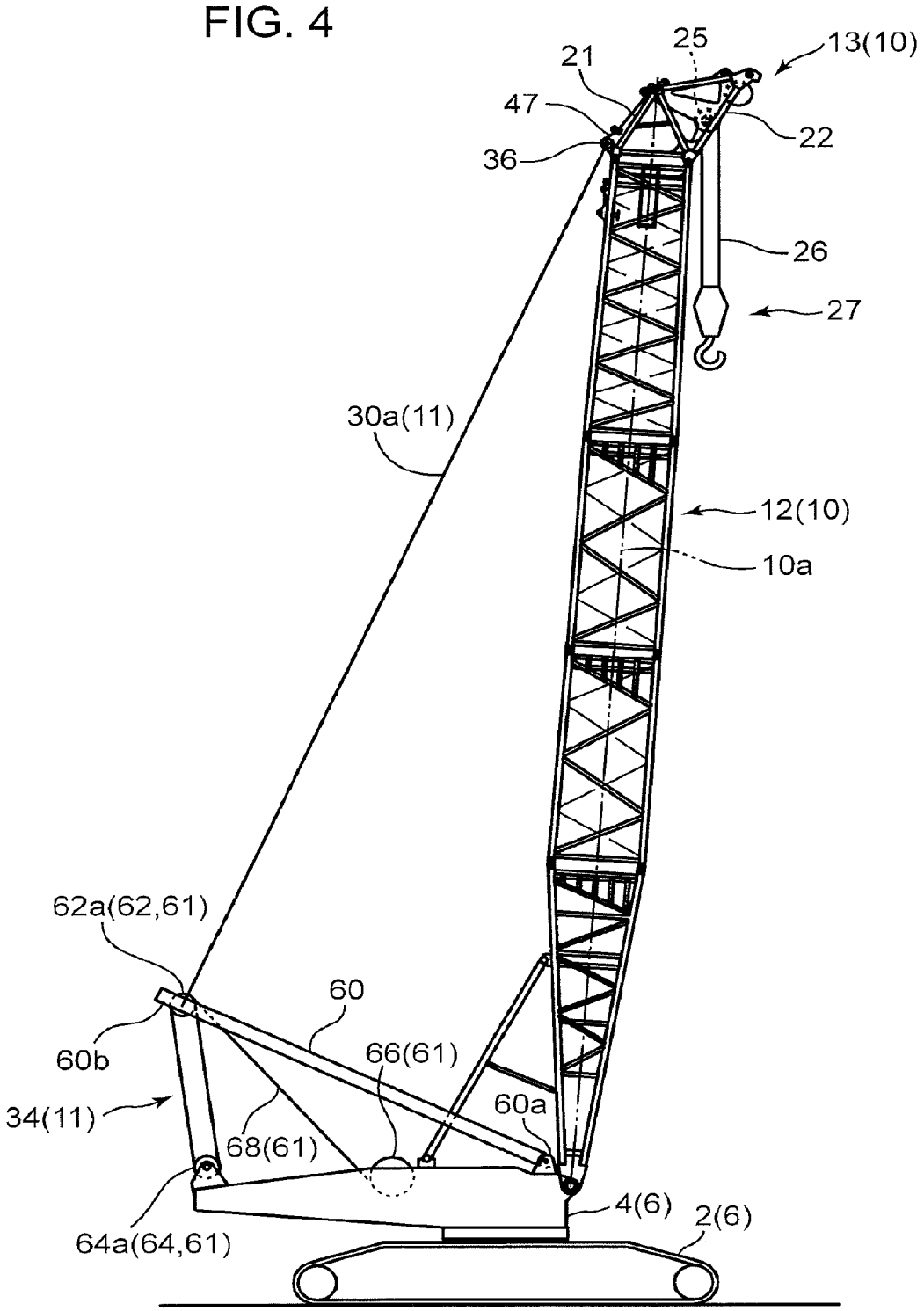
FIG. 4 is a side view of a crane according to a comparative example.

On the other hand, FIG. 4 shows, as a comparative example, a crane which includes no support device 38, and in which a joint 36 is disposed at a second attachment member 47 and at a position close to a back surface 21 of a boom head 13. In this comparative example, a compressive force P2 (see FIG. 5) that acts on a boom 10 can be calculated as the resultant of a tensile force T2 of a guy line 30*a* and a hoisting load W at an intersection point N2 where the extension of the guy line 30*a* meets the straight line extending vertically upward from a rotary axis of a top sheave 25.

As shown in FIG. 5, the distance L1 between the acting position of the compressive force P1 acting on the boom 10 and the axis 10*a* on the plane perpendicularly intersecting the axis 10*a* of the boom 10 in the first embodiment is smaller than the distance L2 between the acting position of the compressive force P2 acting on the boom 10 and an axis 10*a* on the corresponding same plane in the comparative example. In other words, the acting position of the compressive force P1 acting on the boom 10 in the first embodiment is close to the axis 10*a* of the boom 10 as compared to the acting position of the compressive force P2 acting on the boom 10 in the comparative example. Therefore, the bending moment generated in the boom 10 due to the action of the compressive force P1 on the boom 10 in the first embodiment is smaller than the bending moment generated due to the action of the compressive force P2 on the boom 10 in the comparative example. Therefore, in the first embodiment, it is possible to suppress the deflection of the boom 10 due to the bending moment and, in turn, to hoist a greater hoisting load. Consequently, the hoisting capacity can be improved.

In the crane according to the first embodiment, the length of the boom 10 is changed to an appropriate length depending on the contents of hoisting work, the conditions of work site or the like, by changing the number of boom units 14 to be connected or replacing a boom unit 14 to be used with another having a different length. In this case, the first linking member 49 provides the joint 36 with the plurality of different positions in the A-direction to allow positional change of the joint 36. Therefore, it is possible to achieve both an improvement of the hoisting capacity and the reduction of the tensile force required to raise the boom 10.

Specifically, when the boom 10 is made shorter, the pin 55 of the joint 36 is fitted into the hole 49*a* closer to the distal end 49*c* of the first linking member 49 to locate the joint 36 at a position further behind the axis 10*a* of the boom 10 being in the vertical position. For example, the joint 36 is disposed at the position shown in FIG. 5. In this case, the acting position of a compressive force can be located closer to the axis 10*a* of the boom 10 being in the vertical position, the acting position having shifted forward with respect to the axis 10*a* of the boom 10 due to the reduction in the length of the boom 10. Therefore, it is possible to suppress the deflection of the boom 10 due to the bending moment and, in turn, to improve the hoisting capacity for the same reasons as described above with reference to FIG. 5.

On the other hand, when the boom 10 is made longer, the pin 55 of the joint 36 is fitted into the hole 49*a* formed between the distal end 49*c* and the proximal end 49*b* of the first linking member 49 to locate the joint 36 at a position closer to the axis 10*a* of the boom 10. For example, the joint 36 is disposed at the position shown in FIG. 3. In this case, the angle of the guy line 30 with respect to the axis 10*a* of the boom 10 being in the horizontal position can be increased, the angle having decreased due to the increase in the length of the boom 10. Specifically, the angle θ shown in FIG. 6 can be increased. This can make the vertical component of a tensile force of the guy lines 30 great when the boom 10 in the horizontal position is raised. As a result, the tensile force of the guy line 30 required to raise the boom 10 can be reduced.

Further, in the first embodiment, the second linking member 50 extending in the direction intersecting the first linking member 49 supports a portion of the first linking member 49 where the hole 49*a* fitted with the pin 55 of the joint 36 is formed, via the pin 55. Therefore, the second linking member 50 allows the portion of the first linking member 49 where the hole 49*a* fitted with the pin 55 is formed to withstand a great tensile force of the guy line 30 acting thereon from the joint 36. Consequently, it is possible to prevent deformation or breakage of the first linking member 49.

Second Embodiment

Figure 7:
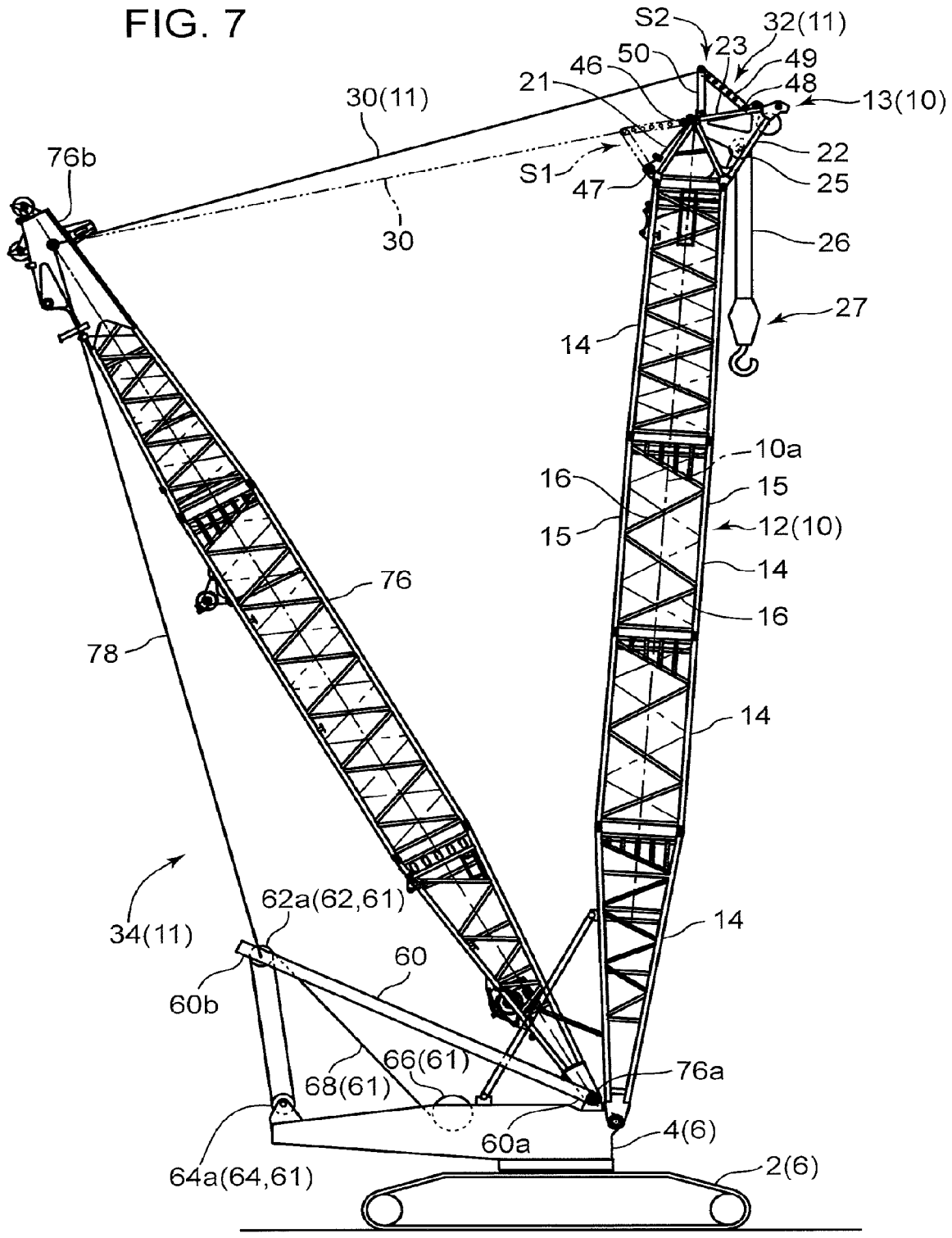
FIG. 7 is a side view of a crane according to a second embodiment of the present invention.
Figure 8:
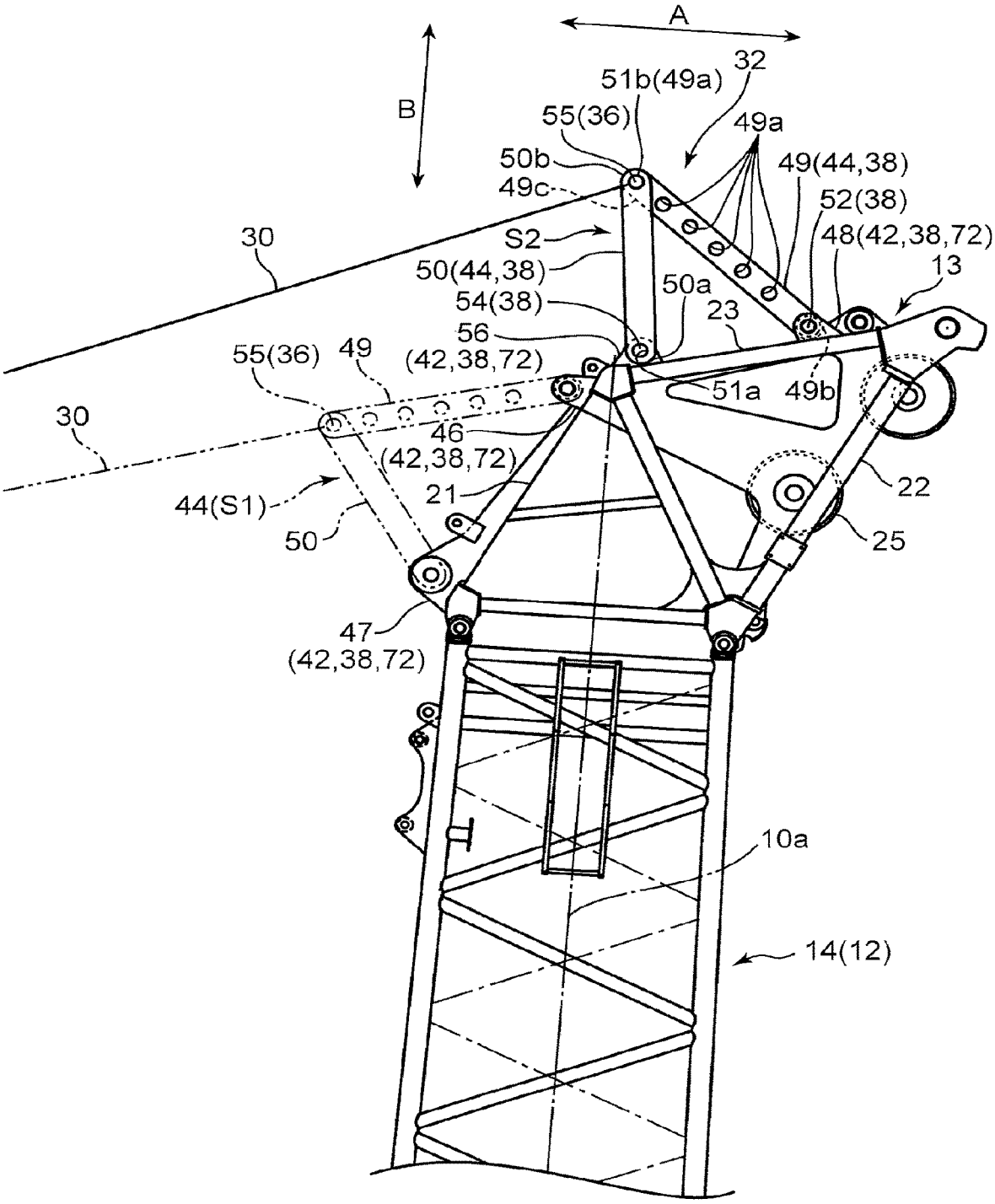
FIG. 8 is an enlarged view of a distal end of the boom of the crane shown in FIG. 7.

FIGS. 7 and 8 show the structure of a crane according to a second embodiment of the present invention. In the crane according to the second embodiment, the relative position of a joint 36 to a boom head 13 can be changed to a plurality of positions, not only in the A-direction, but also in a B-direction along an axis of a boom 10. The B-direction serves as an example of a second direction of the present invention.

In addition, the crane according to the second embodiment can be switched between a normal mode and a heavy lift mode. The crane mode is switched between the normal mode and the heavy lift mode depending on the magnitude of a hoisting load. Specifically, when the magnitude of a hoisting load is equal to or less than a predetermined set value, the crane mode is set to the normal mode, and when the magnitude of a hoisting load is greater than the set value, the crane mode is set to the heavy lift mode. In the second embodiment, when the crane is set to the heavy lift mode, the joint 36 is disposed at a position closer to the distal end of the boom 10 in the B-direction. Hereinafter, a specific structure of the crane according to the second embodiment will be described.

The normal mode corresponds to the mode of the crane shown in FIG. 1. In other words, the structure of the crane in the normal mode corresponds to the structure of the crane in the first embodiment and, therefore, description thereof will be omitted.

The heavy lift mode corresponds to the mode of the crane shown in FIG. 7. In the heavy lift mode, a guy line operating device 34 includes, in addition to a crane mast 60 and a mast rotating device 61, an HL mast 76 independent of the crane mast 60. The crane mast 60 of the second embodiment serves as an example of a first mast of the present invention, and the HL mast 76 serves as an example of a second mast of the present invention.

The HL mast 76 has a lattice structure and has a longer dimension in one direction. The HL mast 76 includes a proximal end 76*a* and a distal end 76*b* constituting axially opposite ends thereof.

The proximal end 76*a* is detachably mounted on an upper slewing body 4. The proximal end 76*a* is mounted on the upper slewing body 4 rotatably about a common axis with a proximal end 60*a* of the crane mast 60. This allows the HL mast 76 to swing between the boom 10 and the crane mast 60 with the proximal end 76*a* serving as the center of the movement.

Further, in the second embodiment, the guy line operating device 34 includes a connecting rope 78 connecting a distal end 60*b* of the crane mast 60 and the distal end 76*b* of the HL mast 76. The connecting rope 78 serves as an example of a connecting member of the present invention. Further, the respective ends of the two guy lines 30 opposite to the linking devices 32 are connected to the distal end 76*b* of the HL mast 76. Consequently, the distal end 76*b* of the HL, mast 76 and the boom head 13 are connected via the guy lines 30 and the linking devices 32. The distal end 76*b* of the HL mast 76 lies at a higher level than the distal end 60*b* of the crane mast 60.

In the second embodiment, the mast rotating device 61 rotates the crane mast 60 to rotate the HL mast 76 via the connecting rope 78 to draw the guy lines 30 rearward or advance the guy lines 30.

Further, in the second embodiment, an attachment section 42 of a support device 38 supports a first linking member 49, and provides the first linking member 49 with a plurality of different positions in the B-direction to allow positional change of the first linking member 49.

Specifically, the attachment section 42 includes a first attachment member 46 and a second attachment member 47 having the same structures as the first attachment member 46 and the second attachment member 47 of the above-described first embodiment, respectively, and further includes a third attachment member 48 and a fourth attachment member 56. The first attachment member 46 and the third attachment member 48 of the second embodiment serve as an example of attachment members of the present invention.

The third attachment member 48 is in the form of two plates vertically disposed on a top surface 23 at a position near a ventral surface 22 of the boom head 13. Therefore, the third attachment member 48 is mounted on the boom head 13 at a different position from the first attachment member 46 in the B-direction, i.e. at a position closer to the distal end of the boom 10 than the first attachment member 46 is. The two plates of the third attachment member 48 are disposed in such a way that a plate thickness direction thereof coincides with the widthwise direction. The two plates are slightly spaced from each other in the widthwise direction, and are disposed at positions respectively corresponding to the positions of the two plates of the first attachment member 46 in the widthwise direction. Each plate of the third attachment member 48 is formed with an attachment hole passing therethrough at the same position in the plate thickness direction.

The fourth attachment member 56 is in the form of a single plate disposed vertically on the top surface 23 of the boom head 13 at a position near a back surface 21 of the boom head 13. The fourth attachment member 56 is disposed in such a way that a plate thickness direction thereof coincides with the widthwise direction. The fourth attachment member 56 is disposed in the middle between the two plates of the third attachment member 48 in the widthwise direction. The fourth attachment member 56 is formed with an attachment hole passing therethrough in the plate thickness direction.

The form of attachment of the link 44 to the attachment section 42 is changed from a first form of attachment S1 (see FIG. 8) in which a link 44 is attached to the first and second attachment members 46 and 47 to a second form of attachment S2 (see FIG. 8) in which the link 44 is attached to the third and fourth attachment members 48 and 56, whereby the position of the first linking member 49 can be changed between the plurality of different positions in the B-direction.

The first form of attachment S1 is the same as the form of attachment of the link 44 in the above-described first embodiment shown in FIG. 2. In the first form of attachment S1, the first linking member 49 is attached to the first attachment member 46 and a second linking member 50 is attached to the second attachment member 47. In the first form of attachment S1, the joint 36 (pin 55) supported by the link 44 is disposed on the boom body 12 side (a proximal end side of the boom 10) from the top surface 23 of the boom head 13. The first form of attachment S1 is adopted in the normal mode of the crane.

On the other hand, in the second form of attachment S2, as shown in FIG. 8, a proximal end 49*b* of the first linking member 49 is attached to the third attachment member 48, and proximal ends 50*a* of the second linking member 50 are attached to the fourth attachment member 56.

In this second form of attachment S2, the proximal end 49*b* of the first linking member 49 is placed between the two plates of the third attachment member 48, and a pin 52 is fitted into a hole 49*a* formed in the proximal end 49*b* and the attachment holes of the plates of the third attachment member 48 to attach the proximal end 49*b* of the first linking member 49 to the third attachment member 48. The pin 52 can be inserted to and removed from the hole 49*a* of the proximal end 49*b* and the attachment holes of the third attachment member 48. The proximal end 49*b* can be detached from the third attachment member 48 by removing the pin 52 from these holes. In other words, the proximal end 49*b* of the first linking member 49 is attachable to and detachable from the third attachment member 48.

Further, in the second form of attachment S2, the proximal ends 50*a* of the two flat plates of the second linking member 50 are placed on both sides of the fourth attachment member 56 in its plate thickness direction in such a way that holes 51*a* communicate with the attachment hole of the fourth attachment member 56 and, in this state, a pin 54 is fitted into the holes 51*a* of the proximal ends 50*a* and the attachment hole of the forth attachment member 56. Consequently, the proximal ends 50*a* of the second linking member 50 are attached to the fourth attachment member 56. The pin 54 can be inserted to and removed from the holes 51*a* of the proximal ends 50*a* and the attachment hole of the forth attachment member 56. The proximal ends 50*a* can be detached from the fourth attachment member 56 by removing the pin 54 from these holes. In other words, the proximal ends 50*a* of the second linking member 50 are attachable to and detachable from the fourth attachment member 56.

In the second form of attachment S2, the link 44 projects from the top surface 23 of the boom head 13 away from the boom body 12 in the B-direction. Consequently, the joint 36 supported by the link 44 lies at a position away from the top surface 23 of the boom head 13 and opposite to the boom body 12 (opposite to the proximal end of the boom 10). This second form of attachment S2 is adopted in the heavy lift mode of the crane.

The crane according to the second embodiment has the same structures as those of the crane according to the first embodiment except for the above-described structure.

In the second embodiment, it is possible to use the crane in the heavy lift mode to make it possible to perform a task of hoisting a heavy hoisting load while suppressing the deflection of the boom 10 that occurs in the heavy lift mode.

Specifically, in the normal mode (see FIG. 1) of the crane, the distal end 60*b* of the crane mast 60 lies at a level significantly lower than the boom head 13 of the boom 10 being in the vertical position. Therefore, the angle between guy lines 30 and the axis 10*a* of the boom 10 is small, which makes the component of a tensile force of the guy line 30 acting in a direction perpendicularly intersecting the axis 10*a* of the boom 10 small. Therefore, in the normal mode, a task of hoisting a heavy hoisting load is difficult to be performed. In contrast, when the HL mast 76 is mounted on the upper slewing body 4 to use the crane in the heavy lift mode, the guy lines 30 are connected to the distal end 76*b* of the HL mast 76 that lies at a level higher than the distal end 60*b* of the crane mast 60 and close to the level of the boom head 13 of the boom 10 being in the vertical position. Therefore, the angle of the guy lines 30 with respect to the axis 10*a* of the boom 10 is greater than that in the normal mode, which can make the component of a tensile force of the guy line 30 acting in the direction perpendicularly intersecting the axis 10*a* of the boom 10 great. Consequently, it is possible, in the heavy lift mode, to perform a task of hoisting a hoisting load greater than a maximum hoisting load that can be hoisted in the normal mode.

In addition, when the crane is set to the heavy lift mode, the link 44 is shifted from the first form of attachment S1 adopted in the first normal mode to the second form of attachment S2 to locate the joint 36 at a position closer to the distal end of the boom 10. Consequently, the angle between the guy lines 30 and the axis 10*a* of the boom 10 can be adjusted to a slightly smaller angle.

Specifically, as shown in FIGS. 7 and 8, when the link 44 is shifted to the second form of attachment S2 with the joint 36 being connected to the distal end 76*b* of the HL mast 76 via the guy lines 30, the angle between the guy lines 30 and the axis 10*a* of the boom 10 is slightly smaller than that in the case where the joint 36 is connected to the distal end 76*b* of the HL mast 76 via the guy lines 30 with the link 44 being kept in the first form of attachment S1. This allows the angle at which the guy lines 30 draws the boom head 13 to be slightly smaller, which can slightly weaken the component of a tensile force acting on the boom 10 in the A direction as compared to the case where the link 44 is in the first form of attachment S1. As a result, it is possible to suppress the deflection that occurs in the boom 10 in the heavy lift mode.

Further, when the HL mast 76 is dismounted from the upper slewing body 4 and the crane is returned to the normal mode from the heavy lift mode, the link 44 can be returned to the first form of attachment S1 in which the link 44 projects from the back surface 21 of the boom head 13 to provide the same advantageous effects as in the above-described first embodiment.

It should be noted that the embodiment disclosed above is exemplary in all respects and should not be regarded as restrictive. The scope of the present invention is indicated by the scope of the claims and not by the description given above, and includes all modifications within the same sense and scope as the claims.

For example, the joint of the present invention is not necessarily limited to the structure shown in the above-described embodiments. For example, the joint may be configured to include a pin 55, a second linking member 50 and a connection part disposed in the second linking member 50. In this case, the connection part is connected to the guy line 30 and is disposed, for example, in the middle between proximal ends 50*a* and distal ends 50*b* of the second linking member 50. Further, in this case, the hole 49*a* of the first linking member 49 for connecting the distal ends 50*b* of the second linking member 50 thereto via the pin 55 is changed from one to another to thereby pivot the second linking member 50 about the pin 54, whereby the relative position of the joint (connection part) with respect to the boom head 13 can be changed between the plurality of different positions in the A-direction.

Further, the holding member of the present invention that holds the joint and allows the position of the joint to be selectively changed to a plurality of different positions in the A-direction is not necessarily limited to the above-described first linking member 49. An element having a different structure from the first linking member 49 may also be used as the holding member of the present invention.

Further, the attachment section of the present invention to which the holding member is attached and which allows the position of the holding member to be selectively changed to a plurality of different positions in the B-direction is not necessarily limited to the above-described attachment section 42. An element having a different structure from the attachment section 42 may also be used as the attachment section of the present invention.

Figure 9:
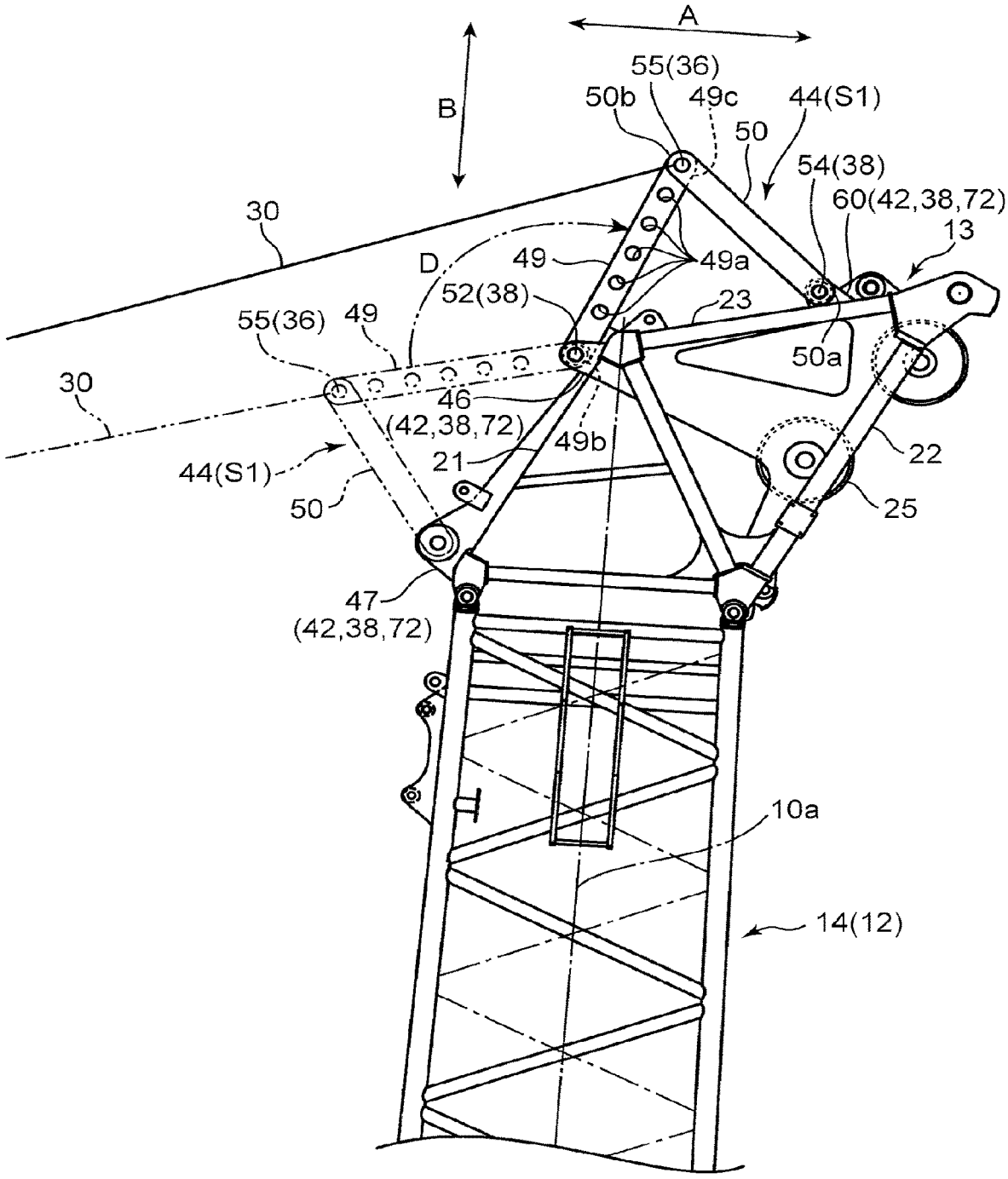
FIG. 9 is an enlarged view of a distal end of a boom of a crane according to a modification of the present invention.

Further, the second form of attachment S2 of the first linking member 49 and the second linking member 50 with respect to the boom head 13 may be modified as shown in FIG. 9.

Specifically, in this modification, an attachment section 42 includes a first attachment member 46, a second attachment member 47, and a third attachment member 60. The first attachment member 46 and the second attachment member 47 have the same structures as those in the above-described embodiments.

The third attachment member 60 is disposed on the top surface 23 of the boom head 13 at the same position as the third attachment member 48 of the above-described second embodiment. However, the third attachment member 60 is in the form of a single plate disposed vertically on the top surface 23. The third attachment member 60 is disposed in such a way that a plate thickness direction thereof coincides with the widthwise direction. Further, the third attachment member 60 is disposed at a position corresponding to the position of the second attachment member 47 in the widthwise direction. In other words, the third attachment member 60 is disposed at a position corresponding to the middle between two plates of the first attachment member 46 in the widthwise direction. The third attachment member 60 is formed with an attachment hole passing therethrough in the plate thickness direction.

In the modified second form of attachment S2, the proximal end 49*b* of the first linking member 49 is, in the same manner as in the first form of attachment S1, attached to the first attachment member 46. It should be noted, however, that in the second form of attachment S2, the first linking member 49 is disposed in such a way as to project from the top surface 23 of the boom head 13.

Further, in the modified second form of attachment S2, the proximal ends 50*a* of the second linking member 50 are attached to the third attachment member 60. The way of attaching the proximal ends 50*a* to the third attachment member 60 is the same as the way of attaching the proximal ends 50*a* to the second attachment member 47. Therefore, the proximal ends 50*a* of the second linking member 50 are attachable to and detachable from the third attachment member 60.

In this modification, when the form of attachment is changed from the first form of attachment S1 to the second form of attachment S2, the pin 54 connecting the proximal ends 50*a* of the second linking member 50 to the second attachment member 47 is removed to detach the proximal ends 50*a* from the second attachment member 47, and the first linking member 49 is pivoted about the pin 52 from the position in the first form of attachment S1 in the direction of D shown in FIG. 9 and the second linking member 50 is pivoted about the pin 55 to a symmetrically opposite side with respect to the first linking member 49. In this manner, the first linking member 49 and the second linking member 50 are shifted to the second form of attachment S2 shown in FIG. 9. Thereafter, the proximal ends 50*a* of the second linking member 50 are connected to the third attachment member 60 via the pin 54. In this modification, the form of attachment is changed from the second form of attachment S2 to the first form of attachment S1 in a reverse procedure to that for changing the form of attachment from the first form of attachment S1 to the second form of attachment S2.

Summary of Embodiments

The embodiments described above can be summarized as follows.

A crane according to the above-described embodiments comprises: a machine body; a boom rotatably mounted on the machine body and having a structure which allows the length of the boom to be changed; and a derricking mechanism configured to rotate the boom to raise and lower the boom with respect to the machine body, wherein: the derricking mechanism includes a guy line, a linking device provided on a distal end of the boom to connect one end of the guy line to the distal end of the boom, and a guy line operating device configured to draw the guy line rearward to raise the boom and configured to advance the guy line to lower the boom; the distal end of the boom has a back surface which faces rearward when the boom is in a vertical position, and a ventral surface which faces forward when the boom is in the vertical position; the linking device includes a joint connected to one end of the guy line, and a support device provided on the distal end to support the joint so as to locate the joint at a position away from the back surface and opposite to the ventral surface; and the support device includes a holding member which holds the joint, the holding member allowing the position of the joint to be selectively changed to a plurality of different positions in a first direction perpendicularly intersecting an axis of the boom and a rotary axis of the boom.

In this crane, the holding member for holding the joint allows the position of the joint to be selectively changed to the plurality of different positions in the first direction perpendicularly intersecting the axis of the boom. This makes it possible to achieve both an improvement of the hoisting capacity and the reduction of the tensile force required to raise the boom.

Specifically, when the boom is made shorter, the joint is disposed at a position further behind the axis of the boom being in the vertical position to reduce the angle between the extension direction of the guy line and the acting direction of a hoisting load to locate the acting position of a compressive force closer to the axis of the boom being in the vertical position, the acting position having shifted forward with respect to the axis of the boom due to the reduction in the length of the boom. Consequently, it is possible to reduce the bending moment generated in the boom to suppress the deflection of the boom and, in turn, to improve the hoisting capacity. On the other hand, when the boom is made longer, the joint is disposed at a position closer to the axis of the boom to increase the angle of the guy line with respect to the axis of the boom, the angle having decreased due to the increase in the length of the boom. This can make the vertical component of a tensile force of the guy line great when the boom in the horizontal position is raised. As a result, the tensile force of the guy line required to raise the boom can be reduced.

It is preferred that, in the above-described crane, the holding member includes a plurality of holding parts respectively disposed at the different positions in the first direction, each of the holding parts being configured to detachably hold the joint.

In this configuration, the position of the joint can be changed in the first direction by detaching the joint held by one of the holding parts from the holding part and then attaching the joint to another one of the holding parts to be held thereby. Therefore, a holding member can be specifically configured that holds the joint and allows the position of the joint to be selectively changed to a plurality of different positions in the first direction.

In the above-described crane, it is preferred that the support device includes a supporting member which is disposed between the holding member and the back surface of the distal end, and the supporting member is coupled with the joint held by the holding member to support the holding member at the position of the joint via the joint.

In this configuration, a portion of the holding member that holds the joint can be supported by the supporting member. Therefore, the supporting member allows the portion of the supporting member that holds the joint to withstand a great tensile force of the guy line acting thereon via the joint. Consequently, it is possible to prevent deformation or breakage of the holding member.

In the above-described crane, it is preferred that: the guy line operating device includes a first mast rotatably mounted on the machine body at a position behind the boom, a second mast disposed between the boom and the first mast and rotatably mounted on the machine body, the second mast including a distal end connected to an opposite end of the guy line, the opposite end being an end opposite to the one end, a connecting member connecting a distal end of the first mast and the distal end of the second mast, and a mast rotating device configured to rotate the first mast to rotate the second mast via the connecting member to draw the guy line rearward or advance the guy line; the distal end of the second mast lies at a higher level than the distal end of the first mast; and the support device includes an attachment section which is disposed at the distal end of the boom and to which the holding member is attached, the attachment section allowing the position of the holding member to be selectively changed to a plurality of different positions in a second direction along the axis of the boom.

According to this configuration, it is possible to use the crane in a heavy lift mode capable of performing a task of hoisting a heavy hoisting load while suppressing the deflection of the boom that occurs in the heavy lift mode. Specifically, in a normal mode of the crane, the guy line is connected to the distal end of the first mast, and the first mast is rotated to draw the guy line rearward to raise the boom or advance the guy line to lower the boom. In this case, the angle between the guy line and the axis of the boom is small, the guy line connecting the distal end of the first mast and the distal end of the boom. Consequently, the component of a tensile force of the guy line acting in the direction perpendicularly intersecting the axis of the boom cannot be made great. This makes a task of hoisting a great hoisting load difficult in the normal mode. In contrast, in the above-stated configuration, the guy line is connected to the distal end of the second mast lying at a higher level than the distal end of the first mast. This allows the angle between the guy line and the axis of the boom to be greater than that in the normal mode in which the guy line is connected to the distal end of the first mast. Consequently, the component of a tensile force of the guy line acting in the direction perpendicularly intersecting the axis of the boom can be made great. In this manner, the crane can be used in the heavy lift mode capable of performing a task of hoisting a great hoisting load. Further, in this configuration, the attachment section which is disposed at the distal end of the boom and to which the holding member is attached allows the position of the holding member to be selectively changed to the plurality of different positions in the second direction along the axis of the boom. This makes it possible to locate the joint at a position closer to the distal end of the boom to adjust the angle between the guy line and the axis of the boom to a slightly smaller angle to thereby slightly weaken the component of a tensile force acting in the direction perpendicularly intersecting the axis of the boom. Consequently, it is possible to suppress the deflection of the boom that occurs in the heavy lift mode of the crane.

In this case, it is preferred that the attachment section includes a plurality of attachment members respectively disposed at the different positions in the second direction in the distal end of the boom, each of the plurality of the attachment members being attachable to and detachable from the holding member.

In this configuration, the position of the holding member can be changed in the second direction by detaching the holding member attached to one of the attachment members from the attachment member and then attaching the holding member to another one of the attachment members. Therefore, an attachment section can be specifically configured that allows the holding member to be attached thereto, and allows the position of the holding member to be selectively changed to a plurality of different positions in the second direction.

As described above, according to the above-described embodiments, it is possible to provide a crane capable of achieving both an improvement of the hoisting capacity and the reduction of the tensile force required to raise a boom being in a horizontal position.

The invention claimed is:

1. A crane, comprising:

a machine body;

a boom rotatably mounted on the machine body and having a structure which allows the length of the boom to be changed; and a derricking mechanism configured to rotate the boom to raise and lower the boom with respect to the machine body, wherein:

the derricking mechanism includes a guy line, a linking device provided on a distal end of the boom to connect one end of the guy line to the distal end of the boom, and a guy line operating device configured to draw the guy line rearward to raise the boom and configured to advance the guy line to lower the boom;

the distal end of the boom has a back surface which faces rearward when the boom is in a vertical position, and a ventral surface which faces forward when the boom is in the vertical position;

the linking device includes a joint connected to the one end of the guy line, and a support device provided on the distal end to support the joint so as to locate the joint at a position away from the back surface and opposite to the ventral surface; and the support device includes:

an attachment section fixedly provided on the distal end of the boom;

a holding member which holds the joint;

a supporting member which holds the holding member, and the holding member and the supporting member are rotatably attached to the attachment section, the holding member includes a plurality of holding parts respectively disposed at different positions in a first direction perpendicularly intersecting an axis of the boom and a rotary axis of the boom and the holding member, allowing the position of the joint to be selectively changed to the plurality of different positions in the first direction by the plurality of holding parts.

2. The crane according to claim 1, wherein each of the holding parts is configured to detachably hold the joint.

3. The crane according to claim 1, wherein the supporting member is disposed between the holding member and the back surface of the distal end, and the supporting member is coupled with the joint held by the holding member to support the holding member at the position of the joint via the joint.

4. A crane, comprising:

a machine body;

a boom rotatably mounted on the machine body and having a structure which allows the length of the boom to be changed; and a derricking mechanism configured to rotate the boom to raise and lower the boom with respect to the machine body, wherein:

the derricking mechanism includes a guy line, a linking device provided on a distal end of the boom to connect one end of the guy line to the distal end of the boom, and a guy line operating device configured to draw the guy line rearward to raise the boom and configured to advance the guy line to lower the boom;

the distal end of the boom has a back surface which faces rearward when the boom is in a vertical position, and a ventral surface which faces forward when the boom is in the vertical position;

the linking device includes a joint connected to the one end of the guy line, and a support device provided on the distal end to support the joint so as to locate the joint at a position away from the back surface and opposite to the ventral surface; and the support device includes a holding member which holds the joint, the holding member allowing the position of the joint to be selectively changed to a plurality of different positions in a first direction perpendicularly intersecting an axis of the boom and a rotary axis of the boom, wherein the guy line operating device includes a first mast rotatably mounted on the machine body at a position behind the boom, a second mast disposed between the boom and the first mast and rotatably mounted on the machine body, the second mast including a distal end connected to an opposite end of the guy line, the opposite end being an end opposite to the one end, a connecting member connecting a distal end of the first mast and the distal end of the second mast, and a mast rotating device configured to rotate the first mast to rotate the second mast via the connecting member to draw the guy line rearward or advance the guy line;

the distal end of the second mast lies at a higher level than the distal end of the first mast; and the support device includes an attachment section which is disposed at the distal end of the boom and to which the holding member is attached, the attachment section allowing the position of the holding member to be selectively changed to a plurality of different positions in a second direction along the axis of the boom.

5. The crane according to claim 4, wherein the attachment section includes a plurality of attachment members respectively disposed at the different positions in the second direction in the distal end of the boom, each of the plurality of the attachment members being attachable to and detachable from the holding member.

* * * * *